US006216976B1

(12) United States Patent
Hendrix

(10) Patent No.: US 6,216,976 B1
(45) Date of Patent: Apr. 17, 2001

(54) REEL WINDING DEVICE AND PROCESS

(75) Inventor: Gottfried Hendrix, Wesel (DE)

(73) Assignee: Voith Sulzer Papiermaschinen Patent GmbH, Heidenheim (DE)

( * ) Notice: Subject to any disclaimer, the term of this patent is extended or adjusted under 35 U.S.C. 154(b) by 0 days.

(21) Appl. No.: 09/264,822

(22) Filed: Mar. 9, 1999

(30) Foreign Application Priority Data

Mar. 13, 1998 (DE) ..... 198 11 093

(51) Int. Cl.[7] ..... B65H 18/26

(52) U.S. Cl. ..... 242/541.7; 242/541.3; 242/908; 242/534

(58) Field of Search ..... 242/534, 539, 242/541.3, 541.4, 541.7, 563, 564.5, 908; 34/184, 186

(56) References Cited

U.S. PATENT DOCUMENTS

| | | | | |
|---|---|---|---|---|
| 3,346,209 | * | 10/1967 | Cronin | 242/541.7 |
| 3,497,151 | * | 2/1970 | Voss et al. . | |
| 3,515,183 | * | 6/1970 | Voss . | |
| 3,912,186 | * | 10/1975 | Bruck et al. . | |
| 3,920,136 | * | 11/1975 | Talbert . | |
| 5,492,287 | | 2/1996 | Raudaskoski et al. . | |
| 5,647,555 | * | 7/1997 | Conrad et al. . | |
| 5,758,842 | | 6/1998 | Dorfel et al. . | |
| 5,779,182 | | 7/1998 | Raudaskoski . | |
| 5,820,063 | * | 10/1998 | Fissman et al. . | |
| 5,839,689 | * | 11/1998 | Kruger et al. | 242/541.4 X |
| 5,848,760 | * | 12/1998 | Kruger et al. . | |
| 5,855,337 | * | 1/1999 | Schonmeir et al. | 242/541.7 |
| 5,899,405 | * | 5/1999 | Kruger et al. | 242/541.4 |
| 5,924,647 | * | 7/1999 | Dorfel | 242/541.7 X |
| 5,988,560 | * | 11/1999 | Hinz et al. . | |

FOREIGN PATENT DOCUMENTS

| | | |
|---|---|---|
| 2124827 | 8/1993 | (CA) . |
| 2239778 | 2/1974 | (DE) . |
| 2724935 | 12/1978 | (DE) . |
| 4201815 | 7/1993 | (DE) . |
| 4427877 | 3/1996 | (DE) . |
| 631956 | 1/1995 | (EP) . |
| 775658 | 5/1997 | (EP) . |
| 95/13980 | 5/1995 | (WO) . |

* cited by examiner

*Primary Examiner*—Donald P. Walsh
*Assistant Examiner*—Collin A Webb
(74) *Attorney, Agent, or Firm*—Greenblum & Bernstein P.L.C.

(57) ABSTRACT

Apparatus and process for at least one of winding and unwinding a material web. The apparatus includes a material web reel and a reel lightening device that includes a blow box and a compressed air supply coupled to the blow box. The blow box may direct the compressed air supply against a periphery of the material web reel to form a gap between the material web reel and the blow box. The apparatus also includes a regulating device coupled to the compressed air supply and adapted to control the gap formed between the material web reel and the blow box at a predefined set point. The process includes positioning the material web reel over the blow box, and blowing the compressed air upwardly toward a periphery of the material web roll, thus, forming a gap between the blow box and the periphery of the material web roll. The process also includes regulating the compressed air supply with the regulating device to maintain a predefined gap width between the blow box and the periphery of the material web roll.

23 Claims, 2 Drawing Sheets

REEL WINDING DEVICE AND PROCESS

CROSS-REFERENCE TO RELATED APPLICATIONS

The present application claims priority under 35 U.S.C. § 119 of German Patent Application No. 198 11 093.6, filed on Mar. 13, 1998, the disclosure of which is expressly incorporated by reference herein in its entirety.

BACKGROUND OF THE INVENTION

1. Field of the Invention

The present invention relates to a reel winding device for a material web reel that includes a reel lightening device with a blow box coupled to a compressed air supply, and to a process for lightening a material web reel in a winding and/or unwinding device. Further, the features of the present invention may be utilized both during winding and unwinding of material web reels. In both cases, similar problems may be solved in a same manner.

2. Discussion of Background Information

In order to reduce setup times, those who work with paper web reels, e.g., printing plants, want increasingly larger paper web reels, i.e., a larger paper web supply. Currently, the trend in the industry is to produce web reels having widths of more than 3 meters and reel diameters of more than 1.5 meters.

However, as the web reel widths become relatively large, the increased weight of the reel, when a certain reel diameter is exceeded, results in sagging of the paper web reel. In this case, the core, which is usually designed as a pasteboard tube, is no longer capable of providing the necessary rigidity.

This sagging during winding has been countered in the prior art by supporting the paper reel from beneath. However, this arrangement requires that the paper reel rest with a certain bearing force on the support, and the bearing pressure determines reel hardness. Thus, because the weight of the reel increases during winding, there is a danger that the reel hardness will increase from the inside out, which is an undesirable hardness pattern.

To avoid affecting reel hardness in this manner, the prior art has proposed to support the reel via an air cushion. In this case, the reel weight is distributed over a relatively large surface such that the bearing pressure remains low.

A blow box, which is fed compressed air from a compressed air supply, is used to generate the air cushion. The blow box is pivoted toward the paper reel as soon as the reel diameter exceeds a specific value of, e.g., approximately 500 mm. To prevent damage to the paper reel, a gap must be maintained between the reel and the blow box. However, this also results in significant energy losses due to escaping compressed air. Further, the pressure relationships in the blow box and, thus, the extent of lightening are permanently altered, particularly since the weight of the paper reel is subject to change as a result of the winding or unwinding.

SUMMARY OF THE INVENTION

The present invention provides a device for reel lightening by compressed air that keeps energy consumption low.

The present invention provides a reel winding device of the type generally discussed above that includes a compressed air supply and a regulating device that regulates a gap between the material web reel and a blow box to a predefined set point.

According to the features of the present invention, the formation of the gap between the material web reel and a blow box, in contrast to the prior art, is not left to chance, i.e., the gap is regulated by the regulating device. Thus, through regulation, it may also possible to take the changing weight of the reel into account. For example, with a smaller diameter of reel and a correspondingly lower reel weight, the necessary counter pressure which is generated by the air pressure is less than with a larger reel diameter, thus, energy savings result. Moreover, it is not necessary to always work with full air pressure. The gap size may be set to a relatively low value, e.g., approximately 0.5 mm. Since a regulating device in the compressed air supply can operate relatively quickly, it may be substantially ensured that, even with these small gap widths, an inadvertent touch-down of the material web reel onto the blow box may be substantially eliminated. With small gaps, the compressed air losses may also less, and it may be observed that significantly more stable pressure relationships may be obtained with such regulation.

It may be preferable to include a sensor device coupled to the regulating device to determine the size of the gap between at least one edge of the blow box and the peripheral surface of the material web reel, i.e., in the peripheral direction of the material web reel. This gap may be primarily utilized for leaking air. Moreover, it may deliver a reliable regulating variable with all relevant reel diameters. At smaller diameters, the material web reel may naturally dip deeper into the blow box than at higher reel diameters. If the gap at the edge of the blow box is monitored in the peripheral direction, then the dip does not affect the gap measurement. The sensor device utilizes at least one distance sensor, and possibly, a distance sensor for both edges. Distance sensors of this type are known, and they may be designed contact free, e.g., as optical sensors, or they may operate mechanically, e.g., a sensing roller attached to the blow box that abuts the periphery of the material web reel. A deflection of the sensing roller relative to the material web reel may then yield information related to the distance of the material web reel from the edge of the blow box.

It is also be preferable for the sensor device to be composed of a sensing roller that extends over the entire axial extent of the blow box. In this way, the sensor device may also provide an additional sealing function in addition to the measurement function. This may be particularly advantageous when such a sensing roller is used on both sides of the blow box.

Further, because the greatest amount of reel sag occurs in the axial center of the material web reel, the blow box may have a shorter axial dimension than the material web reel. Consequently, it suffices in most cases to support the material web reel in this zone, i.e., on both sides of the axial center. Accordingly, the compressed air supply may be restricted to a smaller width, which also reduces energy consumption. It is also easier to provide adequate stability for the desired gap between the blow box and the reel on the shorter length.

When the reel assumes the desired gap with the blow box, the compressed air may leak on the ends of the blow box, which would render regulation more difficult under certain circumstances, and the gap may change as the reel diameter changes. Accordingly, the present invention may also preferably include sealing belts may positioned on the ends of the blow box to endlessly circulate, and an upper strand of the sealing belts may be arranged to abut the material web reel. In this manner, leakage at the end of the blow boxes may be alleviated in a simple manner by utilizing the sealing belt, which is stretched around a circumferential portion of the material web reel, at least as far as the blow box extends in the peripheral direction. The sealing belt merely needs to have a thickness which covers the gap between the blow box and the material web reel at all reel diameters, which is possible with no problem. Since the sealing belt circulates with the material web reel, there is no relative movement between the sealing belt and the surface of the material web reel, thus, no frictional effects which could result in damage to the material web occur. In this case, it is merely necessary to seal the gap between the sealing belt and the ends of the blow box. However, this gap, when it exists, has at least a virtually constant flow-through characteristic, such that it is possible to consider it in the regulation as well.

However, it may be preferable for the sealing belts to abut the ends of the blow box. In this case, there is a moving seal between the blow box and the sealing belts which may not completely prevent escape of compressed air, but does keep the resulting losses low.

It may particularly preferable to provide a pressing device that acts in the axial direction to abuts the sealing belts. Thus, the sealing belts may be pressed with their natural stress against the ends of the blow box, which may improve impermeability.

It may be preferable to provide, at least on a side of the sealing belt positioned adjacent to the blow box, a low frictional surface to contact the outside wall of the blow box. In this case, frictional losses between the moving sealing belt and the blow box may be kept low. Such low-frictional material combinations may be realized in that the sealing belt may be made of, e.g., polytetrafluoroethylene (Teflon) or another plastic, and the blow box may be of stainless steel or another metal. Of course, it may also possible to coat the ends of the blow box with a plastic which cooperates appropriately well with the material of the sealing belt.

Accordingly, the present invention is directed to an apparatus for at least one of winding and unwinding a material web. The apparatus includes a material web reel and a reel lightening device that includes a blow box and a compressed air supply coupled to the blow box. The blow box may direct the compressed air supply against a periphery of the material web reel to form a gap between the material web reel and the blow box. The apparatus also includes a regulating device coupled to the compressed air supply and adapted to control the gap formed between the material web reel and the blow box at a predefined set point.

In accordance with another feature of the present invention, the blow box includes at least one edge that extends in the axial direction, and the controlled gap may be located between the at least one edge and the blow box. The apparatus may further include at least one sensor device coupled to the regulating device and may be adapted to measure a width of the controlled gap. Further, the at least one sensor device may be composed of a sensing roller that extends over an entire axial length of the blow box. Still further, the at least one edge may be positioned on a side of the blow box in which the material web is one of wound onto and wound off of the material web reel.

In accordance with another feature of the present invention, the blow box may have a shorter axial extent than the material web reel. The blow box may include axial ends and the apparatus may further include sealing belts positioned to endlessly circulate around the axial ends. The sealing belts may include a top strand that is arranged to abut the material web reel. Further, the sealing belts may be arranged to abut the axial ends, and the sealing belt may include polytetrafluoroethylene and the axial ends may be at least one of metal and plastic.

Still further, the apparatus may include a pressure device that is arranged for movement in an axial direction of the blow box and that is positioned to abut the sealing belts. The sealing belt may have a low frictional surface on at least side adjacent to an outside wall of the blow box, and the low frictional surface may include polytetrafluoroethylene. Further still, a plurality of guide rolls composed of upper and lower rolls may be arranged for guiding the sealing belt, and a pretensioned spring element may be coupled to bias the upper rolls away from the lower rolls.

The present invention is also directed to a process for lightening a material web reel in one of a winding and an unwinding machine that includes a blow box, a compressed air supply, and a regulator device. The process includes positioning the material web reel over the blow box, and blowing the compressed air upwardly toward a periphery of the material web roll, thus, forming a gap between the blow box and the periphery of the material web roll. The process also includes regulating the compressed air supply with the regulating device to maintain a predefined gap width between the blow box and the periphery of the material web roll.

In accordance with another feature of the present invention, the process may include measuring a width of the gap with at least one sensor device positioned at at least one edge of the blow box, and forwarding the measured width to the regulating device. Further, the gap width may be measured with a non-contacting sensor, or alternatively, the gap width may be measured with a sensing roller that extend along a length of the blow box.

In accordance with another feature of the present invention, the process may further include sealing axial ends of the blow box with circulating sealing belts. Further, the process may include pressing the circulating belts in an axial direction toward the axial ends of the blow boxes. Still further, the circulating sealing belts may be guided around a plurality of guide rolls composed of upper and lower rolls, and the upper rolls may be biased away from the lower rolls.

In accordance with another feature of the present invention, the process may further include abutting the axial ends of the blow box with the circulating sealing belt, and abutting at least a peripheral portion of the material web roll with a top strand of the circulating sealing belt. The sealing belt may be composed of polytetrafluoroethylene, and the axial ends of the blow box may be composed of at least one of metal and plastic.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention is directed to a device for winding or unwinding a material web. While the exemplary embodiment discusses material web reels composed of a paper web, it is noted that this discussion is merely for the purpose of illustration and example and is not intended to be limiting in any way. In fact, the features of the present invention may also be utilized with material web reels composed of, e.g., cardboard, metal foils, or plastic films.

Moreover, while the exemplary embodiment is directed to winding the material web roll, the features may also be utilized in the unwinding of a material web roll.

Figure 1:
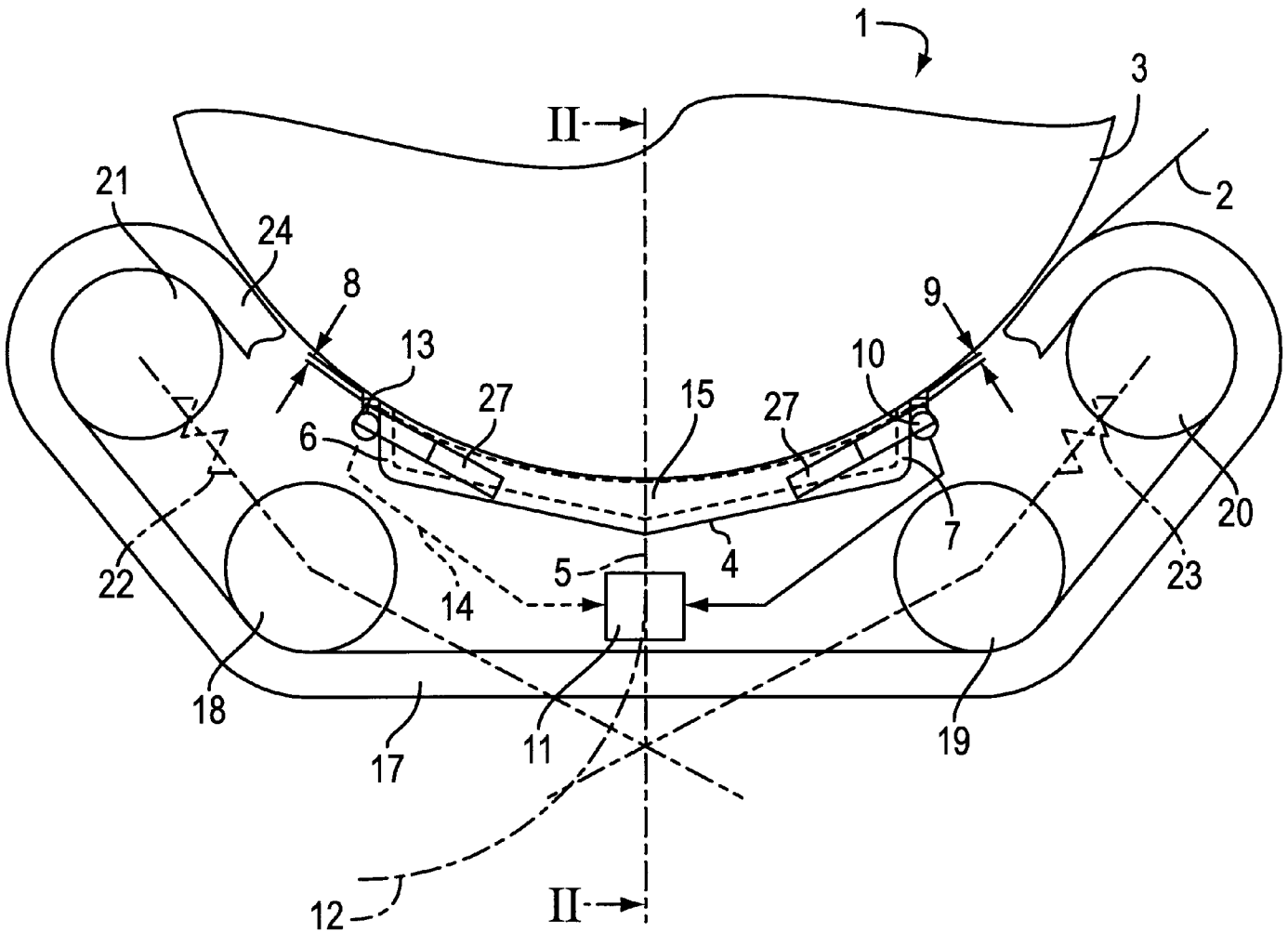
FIG. 1 schematically illustrates a front view of a reel winding device.

A reel winding device 1, as schematically illustrated in FIG. 1, may be utilized to wind or unwind a material web 2, e.g., a paper web or another material web, on a material web reel 3. Reel 3 may be held on its central axis in a manner not depicted in detail.

A blow box 4, which may extend on both sides of a plane running vertically through the reel axis, may be positioned on both sides of the axial center of the reel. Blow box 4 may include a compressed air supply 5 that provides compressed air, i.e., air at an elevated pressure, to be blown into blow box 4. The compressed air forms a pressure cushion on blow box 4, which lightens or lifts reel 3. In this manner, a gap 8 and 9 is created between reel 3 and blow box 4 on two boundary walls 6 and 7 in the peripheral direction of the reel 3. The compressed air may escape through gap 8 and 9.

On at least one wall, and preferably on the wall adjacent to the running in or running out of material web 2, a sensor 10 may be positioned to monitor the size of the gap.

Sensor 10 may be coupled to a regulator 11, which may be arranged between compressed air supply 5 and a compressed air feed line 12. Regulator 11 may be composed of a volume regulator for the compressed air, which regulates the air flowing into blow box 4 so that gap 9 assumes a predefined width. This width, e.g., approximately 0.5 mm, may be maintained throughout the entire winding process, at least from the time that reel 3 has reached or attained a diameter sufficient for reel 3 to protrude above or over two walls 6 and 7 of blow box 4. Sensor 10 may be composed of, e.g., a non-contacting sensor or a sensing roller that extends over the entire axial length of blow box 4.

Of course, during the winding procedure, as the diameter of the reel increases, so does the weight of the reel. Without regulator 11, the increasing weight of reel 3 would result in reel 3 approaching ever closer to blow box 4. Conversely, during an unwinding procedure, reel 3, without regulator 11, would be lifted farther from blow box 4 as the reel weight decreases. Both of these results are undesirable. Thus, through the use of regulator 11, very stable behavior is obtained.

It is also possible to install a corresponding sensor 13 on other wall 6 of blow box 4, and further to couple sensor 13 to regulator 11 through a line 14. With this arrangement, regulator 11 may ensure that a mean value of the two gaps 8 and 9 remains substantially constant and at the same time that a predefined minimum value of the width of gap 8 and 9 is not exceeded.

Regulator 11 may be utilized to control only the width of gap 8 and 9 in the peripheral direction of reel 3.

Figure 2:
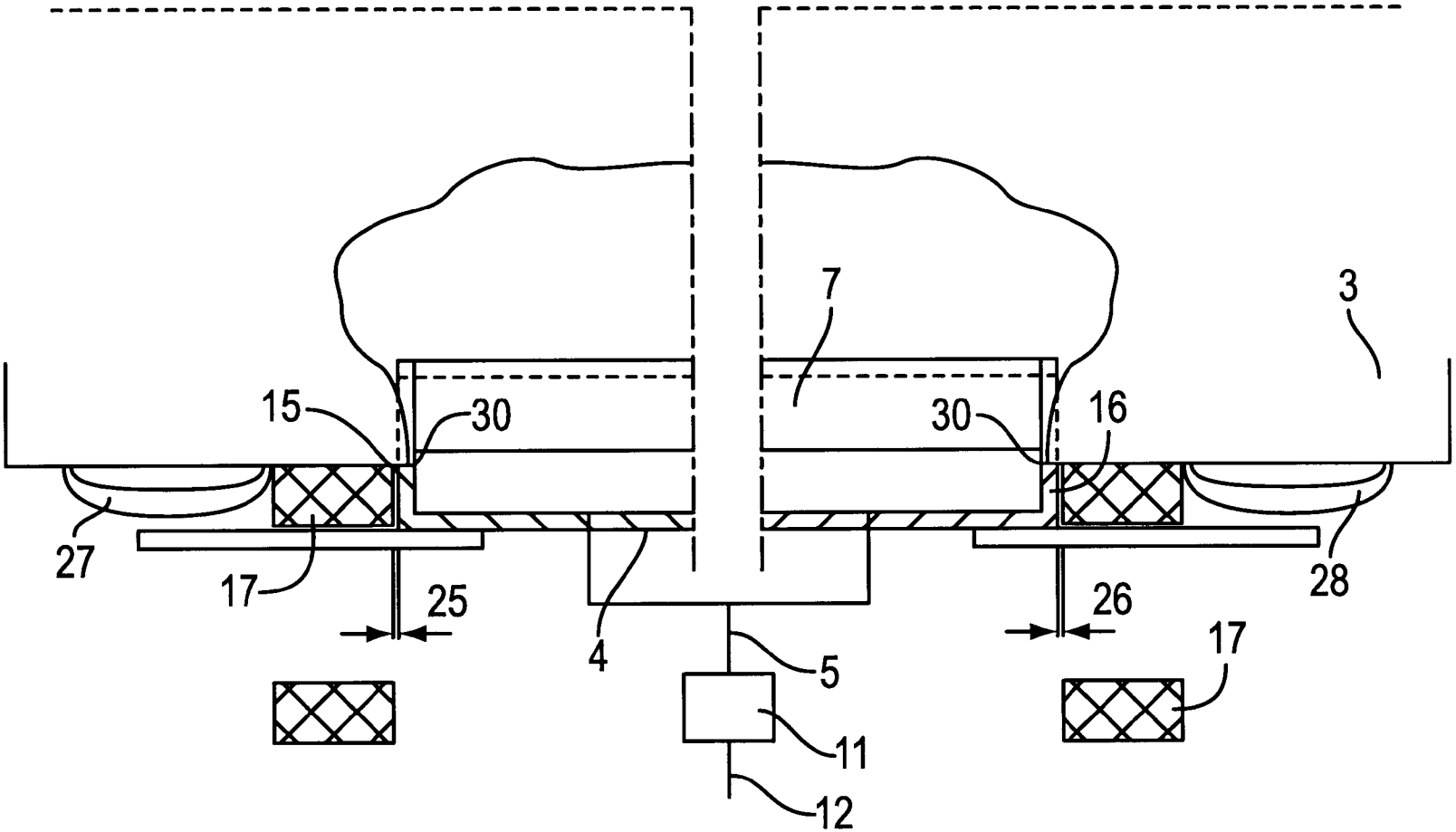
FIG. 2 illustrates a sectional view along II—II depicted in FIG. 1.

As schematically illustrated in FIG. 2, on axial ends 15 and 16 of blow box 4, a gap 30 may be formed between reel 3 and blow box 4, which is related to, e.g., the diameter of reel 3, i.e., as the diameter increases, gap 30 in the center of axial ends 15 and 16 will increase with respect to the gaps 8 and 9 formed at boundary walls 6 and 7. Gap 30 may also be regulated, however, it may be simpler to seal the gap. In this regard, sealing belts 17 may be positioned on both axial ends 15 and 16 of blow box 4. Each sealing belt 17 may be guided by via a plurality of guide rolls, e.g., guide rolls 18, 19, 20, and 21, as an endless belt. Moreover, the two upper guide roll 20 and 21 may be pretensioned, e.g., via springs 22 and 23 or other tension devices, in a direction of reel 3, so that an upper strand 24 of sealing belt 17 is arranged to abuts the periphery of reel 3 in at least one angle zone that is sufficient to cover axial ends 15 and 16 of blow box 4.

Sealing belt 17 may have a thickness which is greater than a largest possible gap between axial ends 15 and 16 of blow box 4 and the periphery of reel 3. In this manner, the gap at axial ends 15 and 16 may be accounted for even after the reel has attained the diameter at which material web reel 3 protrudes beyond edges 6 and 7 of blow box 4.

Between sealing belts 17 and axial ends 15 and 16 of blow box 4, gaps 25 and 26 may develop naturally, but are preferably maintained to be as small as possible or even zero via pressure wheels 27 and 28. Pressure wheels 27 and 28 may press sealing belts 17 against axial ends 15 and 16 of blow box 4. If a suitable material combination is selected, e.g., sealing belts 17 made of Teflon and blow box 4 made of stainless steel, then sealing belts 17 may slide with low friction over axial ends 15 and 16 of blow box 4. Further, despite a moving seal, no large losses develop with this arrangement because virtually no forces have to be transferred. Moreover, since the sealing belts 17 are arranged to circulate at a same speed as the reel 3, no problems develop with the periphery of reel 3.

Accordingly, the air losses may be substantially restricted to gaps 8 and 9, which have a regulatable size. The regulation is performed by a regulator 11, which may be composed of a volume regulator that controls the amount, i.e., volume, of the air flowing into blow box 4 as a function of the size of gap 8 and 9. When gaps 8 and 9 become larger, the amount of air is reduced. When gaps 8 and 9 become smaller, the amount of air is increased. Alternatively, regulator 11 may be composed of a pressure regulator.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. An apparatus for at least one of winding and unwinding a material web comprising:

a material web reel;

a reel lightening device comprising a blow box and a compressed air supply coupled to the blow box, wherein the blow box directs the compressed air supply against a periphery of the material web reel to form a gap between the material web reel and the blow box; and a regulating device coupled to the compressed air supply and adapted to control and maintain the gap formed between the material web reel and the blow box at a predefined set width.

2. The apparatus according to claim 1, wherein the blow box has a shorter axial extent than the material web reel.

3. An apparatus for at least one of winding and unwinding a material web comprising:

a material web reel;

a reel lightening device comprising a blow box and a compressed air supply coupled to the blow box, wherein the blow box directs the compressed air supply against a periphery of the material web reel to form a gap between the material web reel and the blow box;

a regulating device coupled to the compressed air supply and adapted to control the gap formed between the material web reel and the blow box at a predefined set point;

the blow box including at least one edge that extends in the axial direction, wherein the controlled gap is located between the at least one edge and the blow box; and at least one sensor device coupled to the regulating device and adapted to measure a width of the controlled gap.

4. The apparatus according to claimed 3, the at least one sensor device being composed of a sensing roller that extends over an entire axial length of the blow box.

5. The apparatus according to claim 3, the at least one edge being positioned on a side of the blow box in which the material web is one of wound onto and wound off of the material web reel.

6. An apparatus for at least one of winding and unwinding a material web comprising:

a material web reel;

a reel lightening device comprising a blow box and a compressed air supply coupled to the blow box, wherein the blow box directs the compressed air supply against a periphery of the material web reel to form a gap between the material web reel and the blow box; and a regulating device coupled to the compressed air supply and adapted to control the gap formed between the material web reel and the blow box at a predefined set point, wherein the blow box has a shorter axial extent than the material web reel;

the blow box including axial ends; and sealing belts positioned to endlessly circulate around the axial ends.

7. The apparatus according to claim 6, the sealing belts include a top strand that is arranged to abut the material web reel.

8. The apparatus according to claim 7, further comprising a pressure device arranged for movement in an axial direction of the blow box and positioned to abut the sealing belts.

9. The apparatus according to claim 7, the sealing belt having a low frictional surface on at least side adjacent to an outside wall of the blow box.

10. The apparatus according to claim 9, the low frictional surface comprising polytetrafluoroethylene.

11. The apparatus according to claim 7, further comprising a plurality of guide rolls composed of upper and lower rolls arranged for guiding the sealing belt; and a pretensioned spring element coupled bias the upper rolls away from the lower rolls.

12. The apparatus according to claim 6, the sealing belts are arranged to abut the axial ends.

13. The apparatus according to claim 12, the sealing belt comprising polytetrafluoroethylene and the axial ends comprising at least one of metal and plastic.

14. A process for lightening a material web reel in one of a winding and an unwinding machine that includes a blow box, a compressed air supply, and a regulator device, the process comprising:

positioning the material web reel over the blow box;

blowing the compressed airupwardly toward a periphery of the material web roll, thereby forming a gap between the blow box and the periphery of the material web roll; and regulating the compressed air supply with the regulating device to maintain a predefined gap width between the blow box and the periphery of the material web roll.

15. A process for lightening a material web reel in one of a winding and an unwinding machine that includes a blow box, a compressed air supply, and a regulator device, the process comprising:

positioning the material web reel over the blow box;

blowing the compressed air upwardly toward a periphery of the material web roll, thereby forming a gap between the blow box and the periphery of the material web roll;

regulating the compressed air supply with the regulating device to maintain a predefined gap width between the blow box and the periphery of the material web roll;

measuring a width of the gap with at least one sensor device positioned at at least one edge of the blow box; and forwarding the measured width to the regulating device.

16. The process according to claim 15, wherein the gap width is measured with a non-contacting sensor.

17. The process according to claim 15, wherein the gap width is measured with a sensing roller that extend along a length of the blow box.

18. A process for lightening a material web reel in one of a winding and an unwinding machine that includes a blow box, a compressed air supply. and a regulator device, the process comprising:

positioning the material web reel over the blow box;

blowing the compressed air upwardly toward a periphery of the material web roll, thereby forming a gap between the blow box and the periphery of the material web roll;

regulating the compressed air supply with the regulating device to maintain a predefined gap width between the blow box and the periphery of the material web roll; and sealing axial ends of the blow box with circulating sealing belts.

19. The process according to claim 18, further comprising:

pressing the circulating belts in an axial direction toward the axial ends of the blow boxes.

20. The process according to claim 18, wherein the circulating sealing belts are guided around a plurality of guide rolls composed of upper and lower rolls, and wherein the upper rolls are spring biased away from the lower rolls.

21. A process for lightening a material web reel in one of a winding and an unwinding machine that includes a blow box, a compressed air supply and a regulator device, the process comprising:

positioning the material web reel over the blow box;

blowing the compressed air upwardly toward a periphery of the material web roll, thereby forming a gap between the blow box and the periphery of the material web roll;

regulating the compressed air supply with the regulating device to maintain a predefined gap width between the blow box and the periphery of the material web roll;

abutting the axial ends of the blow box with the circulating sealing belt; and abutting at least a peripheral portion of the material web roll with a top strand of the circulating sealing belt.

22. The process according to claim 21, wherein the sealing belt is composed of polytetrafluoroethylene.

23. The process according to claim 21, wherein the axial ends of the blow box are composed of at least one of metal and plastic.

* * * * *

UNITED STATES PATENT AND TRADEMARK OFFICE

CERTIFICATE OF CORRECTION

PATENT NO. : 6,216,976 B1
DATED : April 17, 2001
INVENTOR(S) : Gottfried Hendrix It is certified that error appears in the above-identified patent and that said Letters Patent is hereby corrected as shown below:

Title page,
Item [73], Assignee, "Voith Sulzer Papiermaschinen Patent GmbH, Heidenheim (DE)" should be -- Voith Sulzer Papiertechnik Patent GmbH, Heidenheim (DE) --.

Signed and Sealed this

Twenty-fifth Day of June, 2002

*Attest:*

*Attesting Officer*

JAMES E. ROGAN
*Director of the United States Patent and Trademark Office*